United States Patent [19]

Rowley

[11] Patent Number: 4,467,922

[45] Date of Patent: Aug. 28, 1984

[54] SHEET SHIPPING CONTAINER HAVING DIAGONALLY SUPPORTED BACKWALL

[75] Inventor: James R. Rowley, Freeport, Pa.

[73] Assignee: PPG Industries, Inc., Pittsburgh, Pa.

[21] Appl. No.: 431,402

[22] Filed: Sep. 30, 1982

[51] Int. Cl.[3] ..... B65D 19/00

[52] U.S. Cl. ..... 206/597; 206/386; 206/449; 206/454; 211/13

[58] Field of Search ..... 206/386, 448, 449, 451, 206/453, 454, 597, 600, 455, 456, 322; 211/13, 41; 220/21, DIG. 15; 217/43 A

[56] References Cited

U.S. PATENT DOCUMENTS

| | | | |
|---|---|---|---|
| 2,116,381 | 5/1938 | Burke | 206/597 |
| 2,746,667 | 5/1956 | Murphy | 206/454 |
| 2,896,781 | 7/1959 | Demarest | 206/322 |
| 3,036,752 | 5/1962 | Elliott | 206/386 |
| 3,231,084 | 1/1966 | Kean, Sr. | 206/386 |
| 3,308,941 | 3/1967 | Kean, Sr. et al. | 206/453 |
| 3,493,128 | 2/1970 | Silvert | 206/454 |
| 3,603,455 | 9/1971 | Bareiss | 206/62 R |
| 3,620,388 | 11/1971 | Mansson | 206/600 |
| 3,659,707 | 5/1972 | Nilsson et al. | 206/597 |
| 3,709,358 | 1/1973 | Andrews et al. | 206/62 R |
| 3,863,799 | 2/1975 | Thomaswick et al. | 220/1.5 |
| 3,887,071 | 6/1975 | Thomaswick | 206/454 |
| 4,014,435 | 3/1977 | Rowley et al. | 206/454 |
| 4,026,501 | 5/1977 | Schultz | 211/13 |
| 4,074,823 | 2/1978 | Pater et al. | 214/152 |
| 4,090,659 | 5/1978 | Galmiche et al. | 206/386 |
| 4,091,923 | 5/1978 | Collins | 206/386 |
| 4,105,125 | 8/1978 | Magness | 211/13 |
| 4,171,741 | 10/1979 | Fish | 206/386 |
| 4,317,645 | 3/1982 | Van Gompel | 206/386 |
| 4,326,726 | 4/1982 | Dunchock | 211/13 |
| 4,383,609 | 5/1983 | Lochmiller | 206/386 |

FOREIGN PATENT DOCUMENTS

| | | | |
|---|---|---|---|
| 2038278 | 7/1980 | United Kingdom | 206/386 |
| 396290 | 1/1974 | U.S.S.R. | 206/451 |

*Primary Examiner*—Joseph M. Moy
*Assistant Examiner*—David T. Fidei
*Attorney, Agent, or Firm*—Donald Carl Lepiane; William D. West

[57] ABSTRACT

A container for shipping sheets is disclosed in which there is provided a horizontal base and a vertical backwall. The sheets are stacked on edge on the base and supported in position by the vertical backwall and a plurality of diagonal bands running from the top of the backwall to the front of the base. Methods of loading and unloading the container are also disclosed.

5 Claims, 3 Drawing Figures

SHEET SHIPPING CONTAINER HAVING DIAGONALLY SUPPORTED BACKWALL

BACKGROUND OF THE INVENTION

1. Field of the Invention

This invention relates to a sheet shipping container and, more particularly, to a container for shipping glass sheets in which the container is capable of being unloaded from the front, top or side.

2. Discussion of the Technical Problems

Sheets, and in particular, glass sheets are shipped in containers many of which include vertical standards or posts joined to a base. Such containers are taught in U.S. Pat. Nos. 3,603,455; 3,709,358; 3,863,799; 3,887,071; and 4,074,823. Another type of sheet shipping container is disclosed in U.S. patent application Ser. No. 249,313 filed Mar. 31, 1981, entitled "Sheet Shipping Container".

The containers which include vertical standards or posts joined to a base generally have a rectangular truss or box configuration. Unitized containers such as disclosed in patent application Ser. No. 249,313 provide a backwall which is supported by unitizing the sheets, backwall members, and base.

The containers utilizing vertical standards generally allow for top unloading and in some cases, top and front unloading. If it becomes necessary to unload the container from the side, many containers lose structural integrity when the sidewalls or supporting posts are removed. In the case of some unitized containers in which an internal backwall is only supported by an external corrugated member, once the external corrugated member is removed from the side, the internal backwall is largely unsupported and the glass sheets may fall over.

Due to space constraints and the storage practices of users of vertically stacked glass sheets, it has been found that unitized containers can not always be unpacked or "picked" from the front side. In such situations the choices are: (1) move the container to a position where it can be unloaded from the front, (2) externally support the glass while "end picking", or (3) vertically unpack the glass.

It would be advantageous, therefore, to provide an improved container for shipping glass sheets that allows vertical stacking yet permits unloading the sheets from the top, the front, or from either side. The instant invention is directed toward that end.

SUMMARY OF THE INVENTION

This invention relates to an improvement in sheet shipping containers in which a backwall member secured substantially normal to a base in a generally vertical position is supported by one or more diagonal bands. A plurality of sheets, for example, glass sheets, are positioned on edge on the base and supported in a vertical position by the backwall member. The sheets, backwall members and base are further strengthened by the addition of one or more diagonal bands attached to the upper portion of the backwall member and a front portion of the base member. The diagonal bands are oriented both with the flat side of the diagonal band toward the glass as well as with the edge of the band oriented toward the edge of the glass sheets.

This invention also relates to a container of stacked glass sheets; the container having a base, at least one backwall member mounted on the base in a generally vertical position, and having a plurality of glass sheets positioned on edge supported in the vertical position member in which the container may be unloaded from the side by severing one or more diagonal tension members leaving at least one of the diagonal tension members affixed between the backwall member and the supporting base.

The instant invention further facilitates the unloading of unitized shipping containers for glass sheets as well as other shipping containers of the type having a base and a backwall member in that the diagonal backwall supporting band may be selectively removed in order to facilitate unloading the container from the front, top or from either side. In particular, the instant invention further strengthens, improves, and lends greater versatility to the sheet shipping container disclosed in U.S. patent application Ser. No. 249,313 filed Mar. 31, 1981, entitled "Sheet Shipping Container" which teachings are hereby incorporated by reference.

BRIEF DESCRIPTION OF THE DRAWINGS

FIG. 3 is a detailed sectional view of the diagonal tension member attachment to the backwall member showing a different configuration of diagonal tension member attachment in accordance with the teachings of the invention.

DESCRIPTION OF THE PREFERRED EMBODIMENTS

Figure 1:
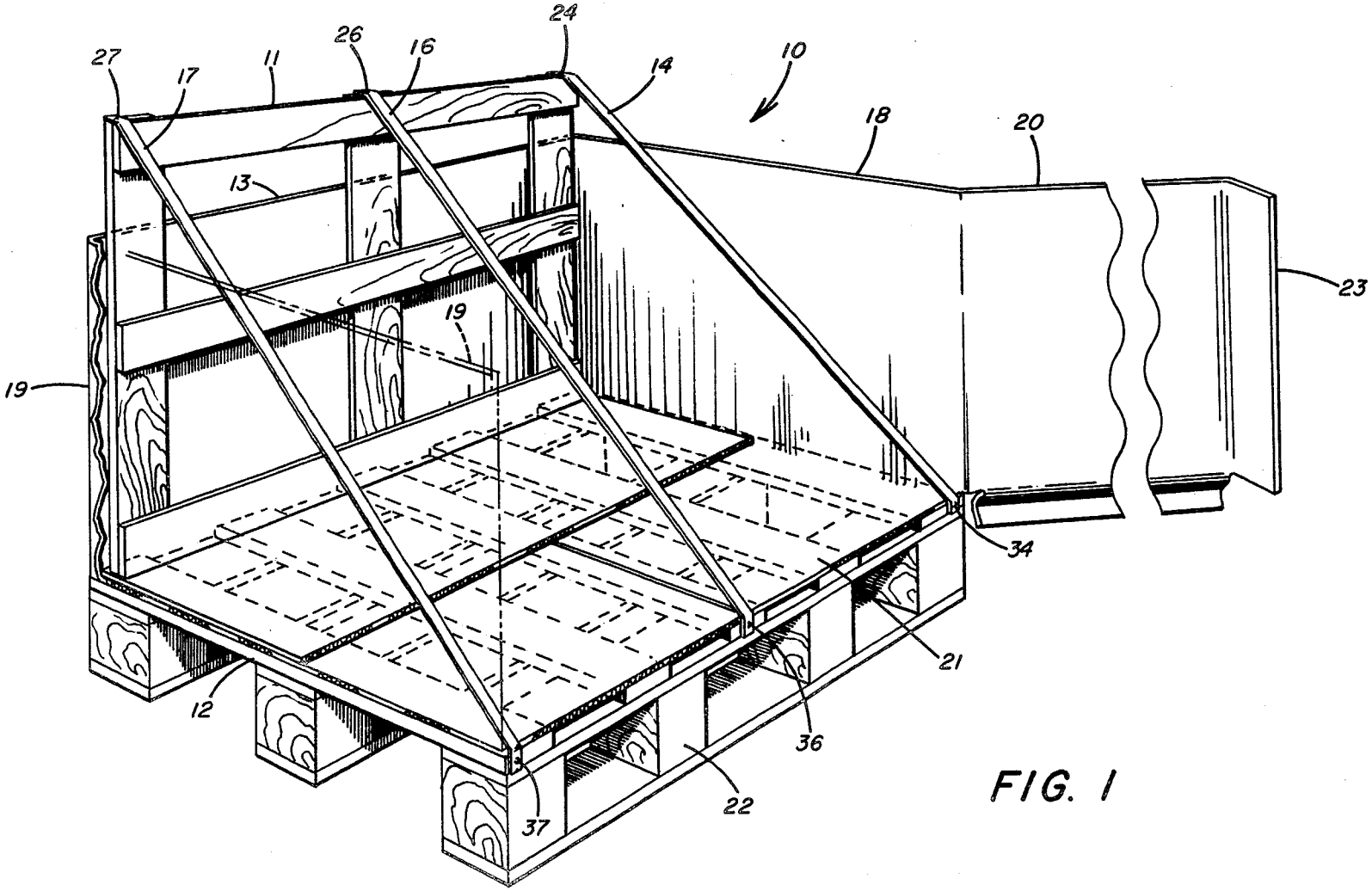
FIG. 1 is an isometric view of the lower portion of a unitized container having glass sheets with portions of the lower section removed for greater clarity.
Figure 2:
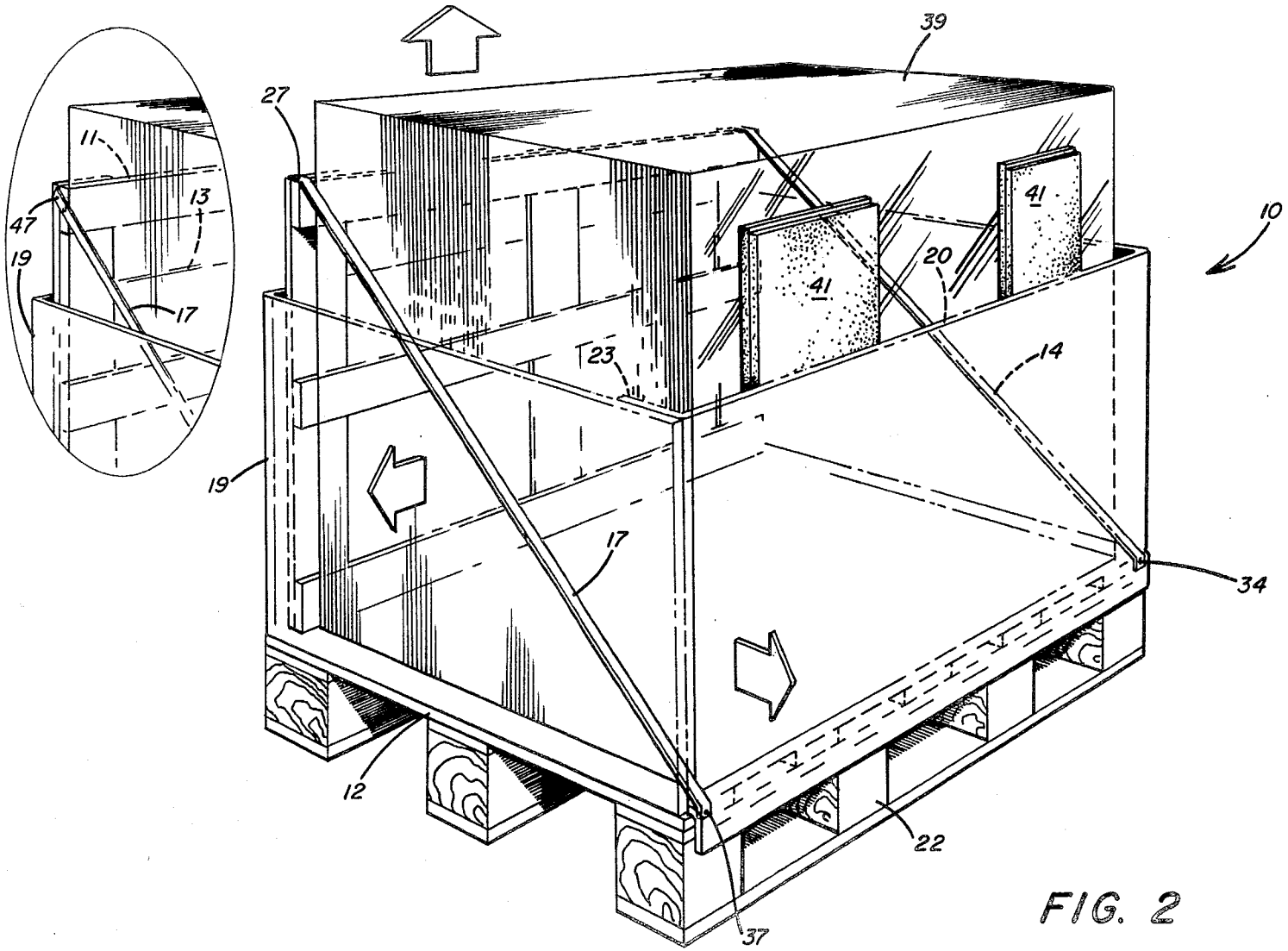
FIG. 2 is an isometric view illustrating the lower portion of a unitized container having a single row of glass sheets therein and depicting diagonal tension members extending from the top of the backwall to the front of the base.

A lower portion 10 of a unitized container incorporating features of the invention for shipping sheets is shown in FIG. 1. FIG. 2 also shows a similar container 10 for shipping sheets 39, for example, refractory sheets such as glass, ceramics and glass ceramics. The container 10 may also include an upper section or lid (not shown) insertable over the stacked sheets 39 and lower container section 10. The lower container section 10 includes sidewalls 18 and 19, external backwall 13 and front wall 20 and internal backwall member 11. Internal backwall member 11 is a rectangular member supported on one edge by horizontal base 12. Internal backwall member 11 is further supported by external backwall member 13 which is the back portion of corrugated material also forming sidewalls 18 and 19 as well as front wall 20. As disclosed in U.S. patent application Ser. No. 249,313, sidewalls 18 and 19, external backwall 13 and front wall 20 have a height approximately equal to or less than the height of the stacked glass sheets 39 as shown in FIG. 2. This height difference provides container 10 with an upper load or container supporting surface having at least the stacked glass sheets as the load bearing member.

The construction of base 12 is not limiting to the invention and is preferably constructed to be structurally stable for supporting the glass sheets 39 with the stacked glass sheets acting as the load bearing member for supporting sequentially stacked sheet loaded containers. The base 12 is preferably constructed to provide access to the lifting and handling of loaded containers, for example, by forklift trucks or slings (not shown). A detailed description of the type of base 12 suitable for use in the instant invention is contained in related U.S. application Ser. No. 249,313. As will be appreciated, the construction and size of the base 12 is not limiting to the invention and may be varied depending upon the size of the sheets to be loaded thereon.

Referring now to FIGS. 1 and 2, the internal backwall member 11 and external fiberboard backwall member 13 provide structural stability; however, by adding elongate tension members 14, 16 and 17, the glass supporting strength is increased. Elongate tension members 14, 16 and 17 are depicted in FIGS. 1, 2 and 3 as bands having upper ends 24, 26 and 27 and lower ends 34, 36 and 37, respectively. By attaching tension members 14, 16 and 17 from the uppermost surface of internal backwall 11 to the front of base 12, additional support for the glass sheets is maintained as tension members 14, 16 and 17 additionally support internal backwall 11. It should be understood that the tension members 14, 16 and 17 can be attached prior to the loading of the glass or after the glass has been loaded as internal backwall member 11 is supported by external backwall member 13 during the loading of the glass.

It is to be understood that the invention is not limited to the size or number of rows or tiers of the glass sheets 39. A single row of stacked glass sheets, a plurality of rows, multiple tiers or a combination of rows and tiers may be packed in the lower container section 10. The invention as practiced in FIG. 1, allows for two rows of single or multiple tiered glass. On the other hand, FIG. 2 depicts a single row of glass sheets packed in accordance with the teachings of this invention.

As it is customary in the loading of glass sheets to load the glass from the front, the front of the base 12 supporting structure 22 is elevated at about a 3° angle to the floor to provide structural packing stability to prevent the sheets from falling over. The sheets are stacked in alternate loading of the rows after which packing dunnage 41, as shown in FIG. 2, is positioned to fill out the remainder of the row of stacked sheets. If the sheets do not completely fill the depth of the lower container, additional dunnage may be used to fill the void. After the glass is loaded, front portion 20 is positioned over the front of the stacked sheets, afterwhich the end flap 23 is attached to sidewall 19 to secure the glass.

Referring now to FIGS. 1, 2 and 3, it can be seen that elongate tension members 14, 16 and 17 are depicted as bands of metal, plastic or other suitable material which are attached to the uppermost portion of internal backwall 11 at ends 24, 26 and 27, respectively. The normal means of attaching tension bands to internal backwall member 11 is by the use of nails, screws, or other similar fasteners well known in the art. The lower end of tension members 14, 16 and 17 are attached to base 12 in a similar fashion. In FIGS. 1 and 2, it can be seen that tension members 14, 16 and 17 are flat, elongated bands; however, rods, cord or other suitable material which provides sufficient strength in tension could be utilized.

Referring now to FIG. 3, it is shown that band member 17 is attached to the side 47 of internal backwall 11 instead of to the top. Also, it can be seen that one of the flat surfaces of the tension member is adjacent to the edge surfaces of the glass. This orientation of the banding member is an alternative to the orientation as depicted in FIGS. 1 and 2.

When it becomes necessary to remove the glass, any upper portion (not shown) of container 10 is removed. If the glass is to be removed or "picked" from the side, it is only necessary to remove the sidewall 19 and cut tension member 17. External backwall 13, sidewalls 18 and 19 and front wall 20 could also be removed as internal backwall 11 is supported by tension member 14. If the glass is to be removed from the opposite side, tension member 14 would be removed or severed and tension member 17 left intact supporting internal backwall 11. It can be seen that by providing the additional tension members 14 and 17 in the case of a single row of glass, or tension members 14, 16 and 17 in the case of a double row of glass, as long as one tension member is attached between the internal backwall member 11 and base 12, internal backwall member 11 will continue to support the glass sheets 39. It is suggested that in the case of a single row that either the right or left tension member be removed whereas in the case of a multiple row pack, such as shown in FIG. 1, both right and left tension members can be removed and center tension member 16 will support the internal backwall. In that case, the glass can be removed from either side, from the front, or vertically.

As can be appreciated, the invention is not limited to the above example which is presented for illustration purposes only. The example is directed to a unitized shipping container such as disclosed in U.S. patent application Ser. No. 249,313; however, any shipping container having a base member and a backwall member would benefit by the addition of tension members.

I claim:

1. A container of stacked glass sheets, comprising:

a plurality of glass sheets;

a rigid base;

an external fiberboard backwall member secured to said base;

an internal backwall member made of a material more rigid than fiberboard supported on said base in a vertical position, said internal and external backwall members each having a height less than the height of the sheets as stacked;

a pair of spaced elongated straps each having an end portion secured to upper half of the internal backwall member and the other end portion of each strap secured to front half of said base to limit pivotal movement of said internal backwall member away from the front half of said base wherein said plurality of glass sheets are mounted on said base between said pair of straps; and means for unitizing said plurality of glass sheets to provide the container with at least the sheets acting as a load bearing member.

2. The container as set forth in claim 1 further including a pair of opposed sidewalls positioned one on each side of said external fiberboard backwall member.

3. The container as set forth in claim 1 wherein said plurality of sheets are adjacent vertical rows of sheets with each row having a height greater than the height of said internal and external backwall members.

4. The container as set forth in claim 1 wherein said plurality of sheets are adjacent horizontal rows of sheets with bottom row supporting upper row wherein the height of the rows is greater than the height of said internal and external backwall members.

5. The container as set forth in claim 3 further comprising a third elongated strap attached to said internal backwall member and said base and having its course between adjacent vertical rows of sheets.

* * * * *